United States Patent [19]

Furuya

[11] 4,429,407

[45] Jan. 31, 1984

[54] COUNTING CIRCUIT FOR COIN COUNTING DEVICE

[75] Inventor: Katusuke Furuya, Tokyo, Japan

[73] Assignee: Laurel Bank Machine Co., Ltd., Tokyo, Japan

[21] Appl. No.: 277,604

[22] Filed: Jun. 26, 1981

[30] Foreign Application Priority Data

Jun. 27, 1980 [JP] Japan ..... 55-87579

[51] Int. Cl.[3] ..... G07D 3/16

[52] U.S. Cl. ..... 377/7; 377/39; 133/8 R; 371/67

[58] Field of Search ..... 377/7, 8, 13, 28, 30, 377/32, 39; 133/8 R; 371/67, 68

[56] References Cited

U.S. PATENT DOCUMENTS

| | | | |
|---|---|---|---|
| 3,848,614 | 11/1974 | Conant et al. | 133/8 R |
| 4,082,099 | 4/1978 | Iwersen | 133/8 R |
| 4,216,788 | 8/1980 | Watanabe et al. | 133/8 R |
| 4,255,809 | 3/1981 | Hillman | 371/68 |

*Primary Examiner*—Gary Chin

*Attorney, Agent, or Firm*—Fleit, Jacobson, Cohn & Price

[57] ABSTRACT

An electrical circuit arrangement for use in a coin counting device is provided. The arrangement is provided with an abnormality detection circuit for generating an alarm signal when any of the optical sensing member of the coin counting device is hindered from operating normally due to adhesion of dust or other causes. The abnormality detection circuit includes a NAND gate, a NOR gate, an OR gate, a counter and an SR-type flip-flop. The first and second detection signal generated from the optical sensing members are supplied to the NAND gate and the NOR gate. The OR gate is supplied with the output from the NOR gate and a reset signal from a reset operator section. The counter is supplied with the output from the NAND gate and the output from the OR gate. In normal operation, the counter counts the level "1" and "0" of the binary logical level alternately, thereby to leave a counting section to continue the counting operation. If any abnormality occurs at any of the combined optical sensing members, the number counted by said counter takes the value 2, whereupon a second output signal indicating the occurrence of abnormality is generated by the counter and fed to the flip-flop which generates an alarm signal.

2 Claims, 4 Drawing Figures

FIG. 4a
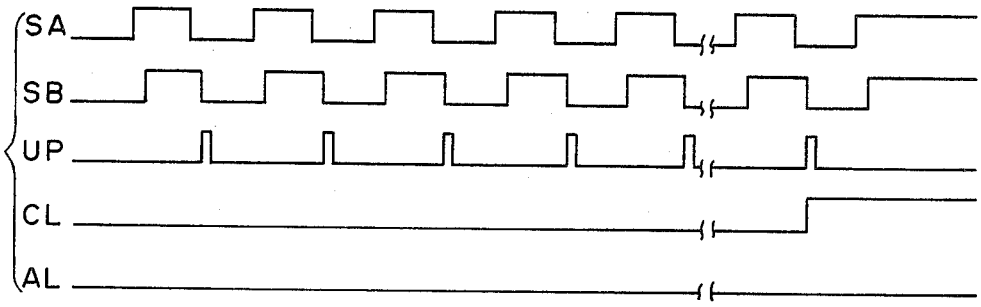
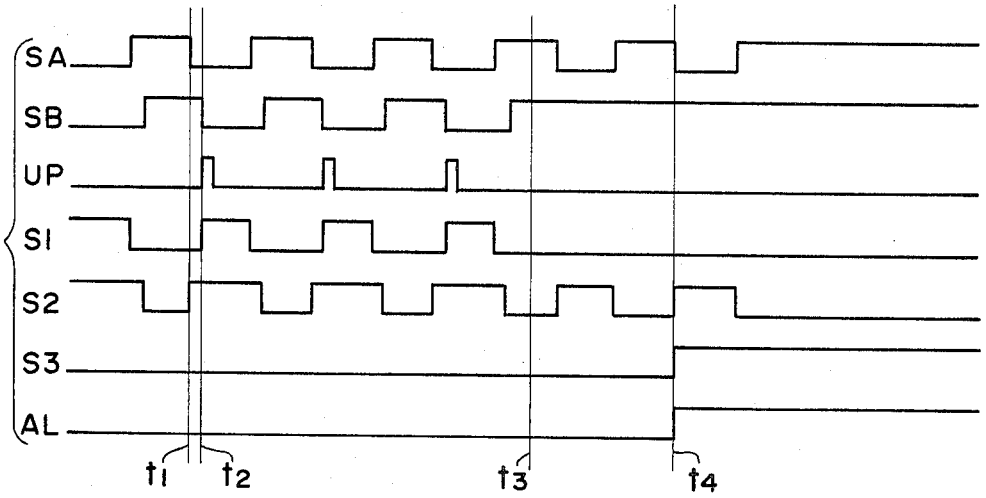
FIG. 4b

COUNTING CIRCUIT FOR COIN COUNTING DEVICE

BACKGROUND OF THE INVENTION

1. Field of the Invention

The present invention relates to a counting circuit arrangement for a coin counting device, and particularly to a circuit arrangement provided with an alarm generating section for generating an alarm signal when dust or other foreign matter adheres to the optical counting elements of the system for counting coins.

2. Prior Art

Optical counting systems for counting passing coins have been known in the art. An illustrative example of the known optical counting systems is shown in FIG. 1. Referring to FIG. 1 showing main parts of the illustrative example, the structure and operation of the known system will be outline.

In FIG. 1, coins are charged on a rotary disk 1 rotating in the direction shown by the arrow A, and then introduced to a coin passage 2 successively one by one. The coins are passed through the coin passage 2 under the action of a guide belt 3 to a coin accumulator tube 4 in which they are accumulated. Along the coin passage 2, there are provided a stopper pin 5 to open or close the coin passage 2 and two photosensors 6 and 7 for detecting the coins passing through the coin passage 2. A light emitting element (not shown) is disposed above the photosensors 6 and 7 in opposed relationship to the photosensors, and the passing coins interrupt the light paths from the light emitting element to the photosensors 6 and 7.

The photosensors 6 and 7 detect the traveling direction of the passing coins and simultaneously count the number of the coins passing therethrough. The counted coins are introduced into the coin accumulator tube 4. When the number of coins accumulated in the accumulator tube reaches the pre-set number, the stopper pin 5 is rotated by 90° by rotary solenoid (not shown) in the direction shown by the arrow B to stop the feeding of coins to the accumulator tube 4.

However, in the prior art device, if dust or other foreign matter should adhere to either one of the photosensors 6 or 7, the moving direction of the coins cannot be detected and only the passage of coins can be detected, resulting in miscounting. There is another problem that a signal causing the miscounting in the counting circuit might be generated when dust or other foreign matter adheres to either one of the optical elements or due to reduction in illuminating power of the light emitting element to lessen the quantiy of light incident onto the photosensors 6 and 7.

OBJECT AND SUMMARY OF THE INVENTION

The primary object of the present invention is to overcome the aforementioned problems or disadvantages of the prior art device.

A more specific object of the present invention is to provide a counting circuit arrangement having an alarm signal generating section for generating an alarm signal when dust or other foreign matter adheres onto any of the optical elements for sensing the passing coins.

Another specific object of the present invention is to provide a counting circuit arrangement having an alarm signal generating section for generating an alarm signal when the illuminating power of the light emitting element is reduced with the lapse of time.

The aforementioned objects can be attained, according to the present invention, by the provision of a counting circuit arrangement for a coin counting device comprising a light generating section having a light emitting element, first and second light receiving sections respectively having first and second photosensors arranged close to each other for receiving light from said light emitting element when they are not covered by any passing coin and for generating detection signals when they are covered by any of the passing coins, an addition-subtraction discriminating section for receiving output signals from said first and second light receiving blocks to put out a count-up or count-down signal, a counter section for receiving the signal from said addition-subtraction discriminating section to count the number of coins passing through said first and second photosensors, and an abnormality detection section connected in parallel with said addition-subtraction discriminating section to receive output signals from said first and second light receiving sections and to put out an alarm signal in response to a difference in the number of pulses between the output signals from said first light receiving section and the output signals from said second light receiving section.

DESCRIPTION OF THE DRAWINGS

The above and other objects and advantages of the present invention will become apparent from the following detailed description of the preferred embodiment with reference to the accompanying drawings, in which:

FIGS. 4(*a*) and 4(*b*) are diagrams showing the wave forms and timing of control operations in the circuit arrangement according to the invention.

DESCRIPTION OF THE PREFERRED EMBODIMENT

The present invention will now be described in detail by referring to a presently preferred embodiment thereof shown in the appended drawings.

Figure 2:
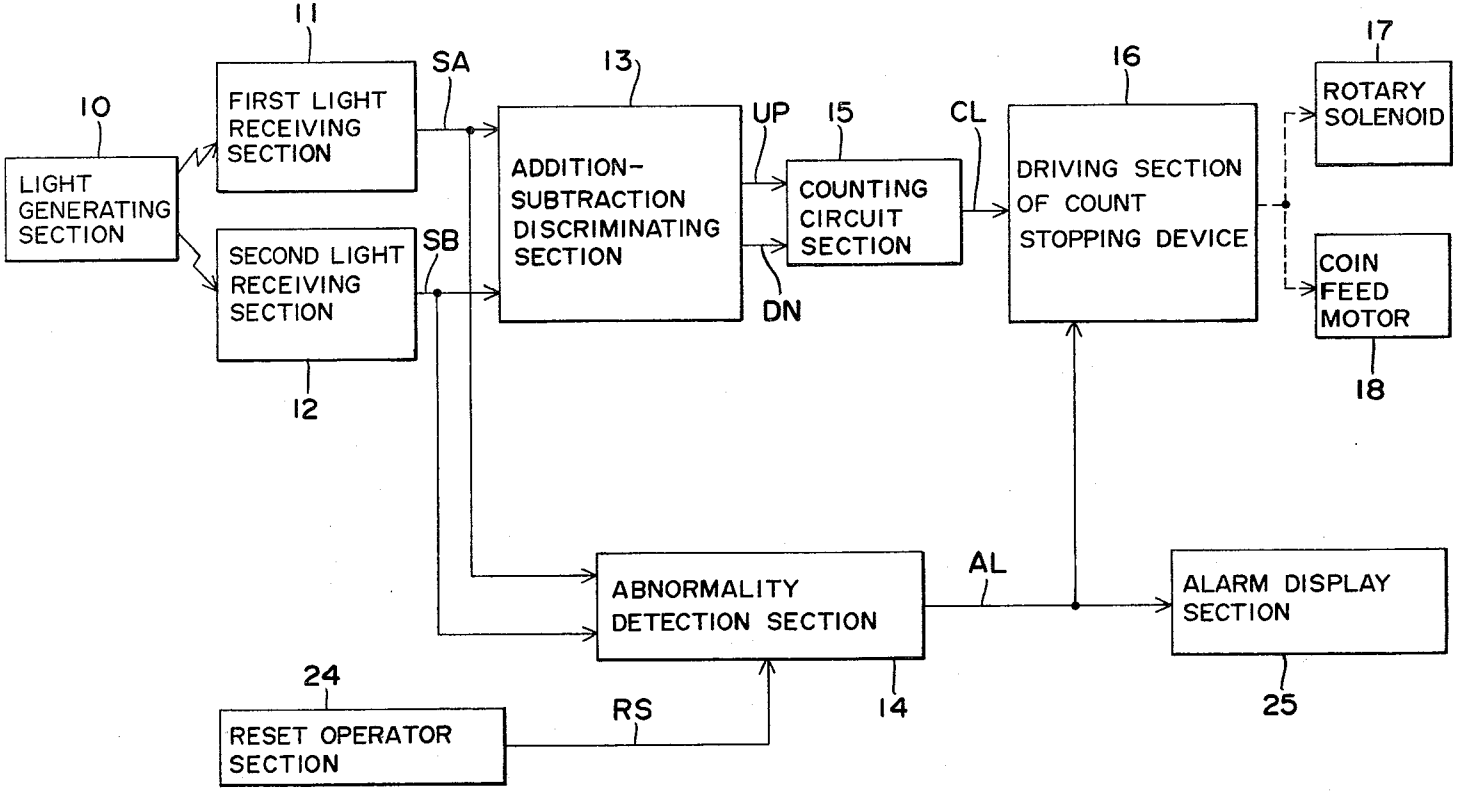
FIG. 2 is a block diagram showing one embodiment of the counting circuit arrangement according to the invention.

Firstly referring to FIG. 2 showing an electric circuit arrangement embodying the present invention, a light generating section including a known light emitting element is denoted by numeral 10. The light emitting element of the light generating section 10 is opposed to photosensors 6 and 7 positioned closely adjacent to each other. The light paths from the light emitting element of the photosensors 6 and 7 traverse the coin passage 2, so that they are intermittently covered by the passing coins. The photosensors 6 and 7 are, respectively, included in first and second light receiving sections 11 and 12.

The first light receiving section 11 includes the photosensor 6, such as a photodiode, and a comparator for converting the electric signal from the photosensor 6 into a binary code signal "1" or "0" of the binary logical level. When the light path to the photosensor 6 is shielded by a passing coin, a first detection signal SA (SA="1") is fed from this light receiving section 11 to an addition-subtraction discriminating section 13 and an abnormality detection section 14.

Similarly, the second light receiving section 12 includes the photosensor 7 and a comparator for converting the electric signal from the photosensor 7 into a binary code signal "1" or "0" of the binary logical level. When the light path to the photosensor 7 is shielded by a passing coin, a second detection signal SB (SB="1") is fed from this light receiving section 12 to the addition-subtraction discriminating section 13 and an abnormality detection section 14.

The addition-subtraction discriminating section 13 receives the first and second detection signals SA and SB to discriminate the sequential order of these signals, namely determining the moving direction of the coin, to put out an addition signal UP or a subtraction signal DN to a counting circuit section 15.

The counting circuit section 15 includes an updown counter and a comparator for comparing the counted number to a pre-set number instructed by digital switches or the like. When the counted number counted by the up-down counter reaches the pre-set number, a coincident signal CL is generated and delivered to a driving section 16 of a count-stopping device.

Figure 1:
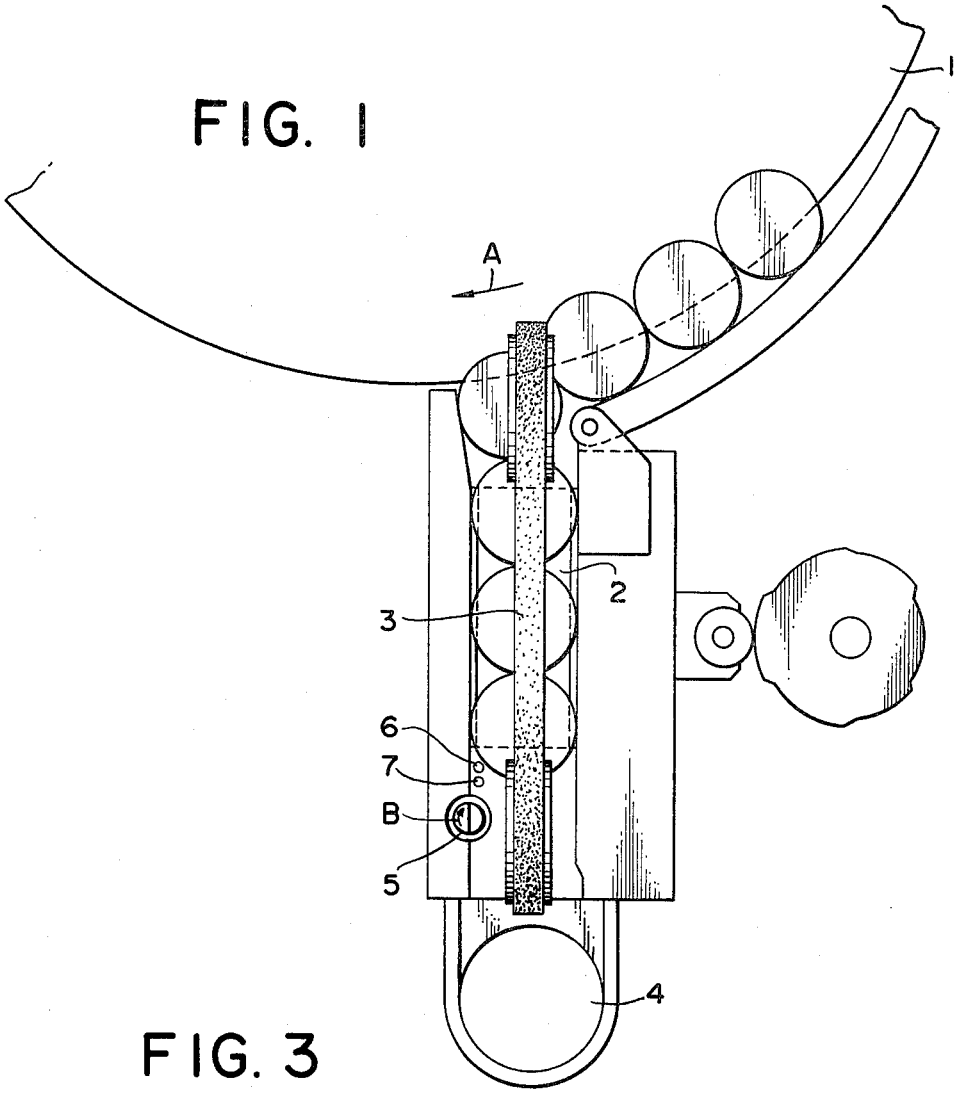
FIG. 1 is a plan view showing diagrammatically a portion of a coin counting device of the prior art which may be combined with the counting circuit arrangement of the invention.

Upon actuation of the driving section 16 of the count-stopping device, a rotary solenoid 17 is driven and a coin feed motor 18 is stopped. As a result, the stopper pin 5 is rotated in the direction of arrow B, as shown in FIG. 1, by the action of the rotary solenoid 17 to block the coin passage 2. On the other hand, the coin feed motor 18 is stopped to stop rotation of the rotary disk 1 and to stop conveying movement of the guide belt 3.

Figure 3:
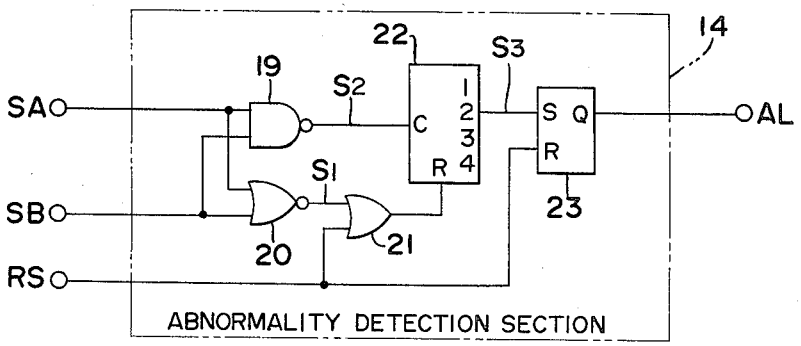
FIG. 3 shows a electric circuit constituting the abnormality detection section included in the circuit arrangement shown in FIG. 2.

The abnormality detection section 14 includes, as shown schematically in FIG. 3, a NAND gate 19, a NOR gate 20, an OR gate 21, a counter 22 and an SR type flip-flop (hereinafter referred to as SRFF) 23. The first and second detection signals SA and SB are, respectively, supplied to the input terminals of the NAND gate 19 and the NOR gate 20. On the other hand, the input terminals of the OR gate 21 are supplied with the output signal S1 from the NOR gate 20 and a reset signal RS from a reset operation section 24. The counter 22 has a clock terminal C to which an output signal S2 fron the NAND gate 19 is supplied, and a reset terminal S to which an output signal from the OR gate 21 is supplied. The SRFF 23 has a set terminal S to which a second output signal S3 from the counter 22 is supplied, and a reset terminal R to which the reset signal RS is supplied. The second output signal S3 of the counter 22 is fed from a second output terminal of the counter 22 such that the second output signal S3 takes the level "1" when the counter 22 counts the number 2. When this second output signal S3 is generated from the counter 22, the SRFF is set to deliver an alarm signal AL to the driving section 16 of the count-stopping device and to an alarm display section 25 having a light emitting element or other suitable means. As a result, the coin passage 2 is blocked and the light emitting element is put on to indicate the occurrence of an abnormal state.

The operation of the alarm circuit arrangement of the abnormality detection section 14 will now be described with reference to the wave form chart of FIG. 4.

The waves generated when a coin passes under normal condition through the coin passage 2 to the coin accumulator tube 4, are shown in FIG. 4(*a*). On the other hand, FIG. 4(*b*) shows the waves generated when any abnormality is sensed, for instance, when dust adheres to the photosensor 7 in the course of the counting operation to hinder the photosensor's sensing of the passing coin.

In the normal operation, the first and second detection signals SA and SB are generated every time a coin is passed through the photosensors 6 and 7. The signals generated as a result of the passage of a succession of coins are fed to the addition-subtration discriminating section 13 from which addition signals UP in a number same as that of the number of passing coins are fed to the counting circuit section 15.

In the abnormality detection section 14, the output signal S2 of the NAND gate 19 rises up at the time $t_1$ when a certain coin shields the lights incident upon the photosensors 6 and 7 and then permits the photosensors 6 to be exposed to the incident light again. In response thereto, the counter 22 counts 1. At the time $t_2$ when the photosensor 7 is again exposed to the incident light, the output signal S1 of the NOR gate 20 takes the level "1" so that the counter 22 is reset. As will be seen from the foregoing description, the abnormality detection section does not put out the alarm signal AL under normal operation condition.

Assuming now that the photosensor 7 is prevented from sensing light due to adhesion of dust at a time $t_3$. After that time, the second detection signal SB continuously takes the level "1" irrespective of the passing of the next coin through the photosensor 7. Also, the addition-subtraction discriminating section 13 does not generate the addition signal UP at that time. When the second detection signal SB takes the level "1", the output signal S1 from the NOR gate is brought to "0" so that the counter 22 is not reset. At a time $t_4$ when the next coin passes through the photosensor 6, the counted number on the counter 22 reaches 2, whereby the SRFF 23 is set. Whereupon, the SRFF 23 generates the alarm signal AL which is fed to the alarm display section 25 and also to the driving section 16 of the count-stopping device.

As a result, counting operation is stopped and the alarm light is lit.

It will be clearly understood by those skilled in that are from the teaching disclosed herein that the coin counting device is prevented from making a mis-counting operation by the provision of the abnormality detection section incorporated in the electrical counting circuit arrangement. By the incorporation of a simple but yet reliable abnormality detection block as specifically disclosed herein, an alarm signal is generated when dust or other foreign matter adheres to any of the optical sensing elements or any of the sensing elements is deteriorated by some cause. It should be also apparent to those skilled in the art that the construction and arrangement of the embodiment can be changed or modified without departing from the spirit and scope of the present invention. For example, although an abnormality is sensed in response to the first and second detection signal Sa and SB in the illustrated embodiment, two counters each for integrating or adding the first and second signals individually may be provided and an abnormal operation be detected by comparing the added numbers of these two counters. Many other changes or modifications may be made by those skilled in the art in the light of the foregoing teachings. Accordingly, the foregoing description is not construed as a limiting sense but should be construed as illustrative only. The scope of the present invention is limited only by the appended claims.

What is claimed is:

1. A counting circuit arrangement for a coin counting device, comprising a light generating section having a light emitting element, first and second light receiving sections respectively having first and second photosensors arranged adjacent to each other for receiving light from said light emitting element when they are not covered by any passing coins and for generating detection signals when they are covered by any of the passing coins, each said light receiving sections having a normal unobstructed sensitivity, an addition-subtraction discriminating section for receiving output signals from said first and second light receiving sections to generate a count-up or count-down signal in dependence on the order of reception of the output signals from the first and second light receiving sections, a counter section for receiving the signal from said additional-subtraction discriminating section to count the number of coins passing through said first and second photosensors, and an abnormality detection section for detecting the difference between the sensitivities of said first and second light receiving sections, said detection section being connected in parallel with said addition-subtraction discriminating section to receive output signals from said first and second light receiving sections and to produce an alarm signal in response to the difference in sensitivities determined by the difference in number of pulses between the output signals from said first light receiving section and the output signals from said second light receiving section.

2. A counting circuit arrangement for a coin counting device, comprising a light generating section having a light emitting element, first and second light receiving sections respectively having first and second photosensors arranged closely adjacent to each other for receiving light from said light emitting element when they are not covered by any passing coins and for generating detection signals when they are covered by any of the passing coins, an addition-subtraction discriminating section for receiving output signals from said first and second light receiving sections to generate a count-up signal when the first light is received before the receipt of the second light and a count-down signal when the first light is received after the receipt of the second light, a counter section for receiving the signal from said addition-subtraction discriminating section to count the number of coins passing through said first and second photosensors, and an abnormality detection section connected in parallel with said addition-subtraction discriminating section to receive the output signals from said first and second light receiving sections and to produce an alarm signal in response to a predetermined difference in number of pulses between the output signals from said first light receiving section and the output signals from said second light receiving section, said abnormality detection section including a NAND gate for receiving said output signals from said first and second light receiving sections, a NOR gate for receiving said output signals from said first and second light receiving sections, an OR gate for receiving the output from said NOR gate and a reset signal from a reset operator section, a counter for receiving the output signal from said NAND gate and the output signal from said OR gate, and a set-reset flip-flop for receiving the output signal from said counter and reset signal to generate an alarm signal when a second output signal indicating occurrence of any abnormal condition is fed thereto by said counter.

* * * * *